United States Patent [19]

Henshaw

[11] Patent Number: 4,580,303

[45] Date of Patent: Apr. 8, 1986

[54] BOTTLE OPENER AND RESEALER

[76] Inventor: Garry E. Henshaw, 6616 St. Estaban, Tujunga, Calif. 91042

[21] Appl. No.: 691,512

[22] Filed: Jan. 14, 1985

[30] Foreign Application Priority Data

Apr. 7, 1984 [DE] Fed. Rep. of Germany ..... 3424609
Apr. 7, 1984 [DE] Fed. Rep. of Germany ... 8420046[U]

[51] Int. Cl.[4] ..... B67B 7/44; B67B 7/04

[52] U.S. Cl. ..... 7/155; 81/3.09; 81/3.55; 81/3.45; 215/226

[58] Field of Search ..... 81/3.07, 3.09, 3.4, 81/3.45, 3.55, 3.57; 7/151, 155; 215/226, 228, 355, 364

[56] References Cited

U.S. PATENT DOCUMENTS 171,752 1/1876 Witte ..... 7/155
519,910 5/1894 Imbaud ..... 215/226
1,653,490 12/1927 Ballou et al. ..... 215/226
2,514,566 7/1950 Capriccio ..... 7/151

FOREIGN PATENT DOCUMENTS 453978 12/1949 Italy ..... 81/3.45
645309 9/1962 Italy ..... 215/355
2091227 7/1982 United Kingdom ..... 81/3.45

*Primary Examiner*—Roscoe V. Parker
*Attorney, Agent, or Firm*—Jack C. Munro

[57] ABSTRACT

A bottle opener and resealer which is combined into a single unit wherein there is incorporated a head member having both a bottle opening recess and a bottle cap resealing recess. A corkscrew member extends from the head member. A removable protective sheath is located about the corkscrew member when not in use. A stopper for a bottle is mounted about the protective sheath which is to be used within the neck of a bottle to close such. The protective sheath is to be removable and associated with the head in order to function as a handle to facilitate operation of the corkscrew member.

5 Claims, 6 Drawing Figures

BOTTLE OPENER AND RESEALER

BACKGROUND OF THE INVENTION

Bottle openers and resealers have long been known. It is common for there to be constructed bottle opening devices. It is also common to construct bottle resealing devices.

Two common types of bottle closures are a cork and a lift off cap. In order to remove a cork there is required some type of cork removal structure such as a corkscrew member. To remove a bottle cap, there is usually utilized a prying type of opening device which facilitates the application of a torque to the bottle cap to remove the cap from the bottle.

At times there have been attempts of combining different types of bottle openers within a single unit. However, in the past, these attempts have resulted in non-attractive appearing devices that are cumbersome to use. Also, none of these attempts have ever combined an opener for both corked and capped bottles which can also serve to reseal both types of bottles.

SUMMARY OF THE INVENTION

The primary objective of the present invention is to construct a bottle opener and resealer which combines an attractive appearance with efficient handling.

Another objective of this invention is to construct a bottle opener and resealer which incorporates both bottle opening and resealing functions for both cork sealed and cap sealed bottles.

Another advantage of the present invention is that it is constructed with safety in mind, that is, all protrusions are recessed or covered so that, when assembled, it can be carried on a person without danger of catching clothing or other objects.

The bottle opener and resealer of this invention is constructed of a basically disc-shaped head which is formed to have a bottle cap opening recess formed in one side of the head with a bottle cap resealing recess formed within the opposite side of the head. A conventional crimped type of bottle cap is to be locatable within the bottle cap resealing recess in a substantially close-fitting manner. Extending within the bottle cap opening recess is a rigid projection. The rigid projection is to be located under the bottle cap and during performing of a prying motion the bottle cap is removed from the bottle. A cylindrical shaped extension is integrally attached to the head. A corkscrew member is mounted within the extension and extends outwardly therefrom. A rigid plastic protective sheath is removably mounted onto the extension to be located about the corkscrew member. A resilient, flexible stopper member is mounted about a portion of the protective sheath. The stopper member is capable of being deflected inwardly toward the protective sheath with such occurring when the stopper member is forced within the neck of a bottle for reclosing such. There is a hole located between the bottle cap opening recess and the bottle cap resealing recess. The protective sheath when removed is capable of extending through the hole so that the protective sheath can function as a handle during operation of the corkscrew member.

DETAILED DESCRIPTION OF THE SHOWN EMBODIMENT

Figure 1:
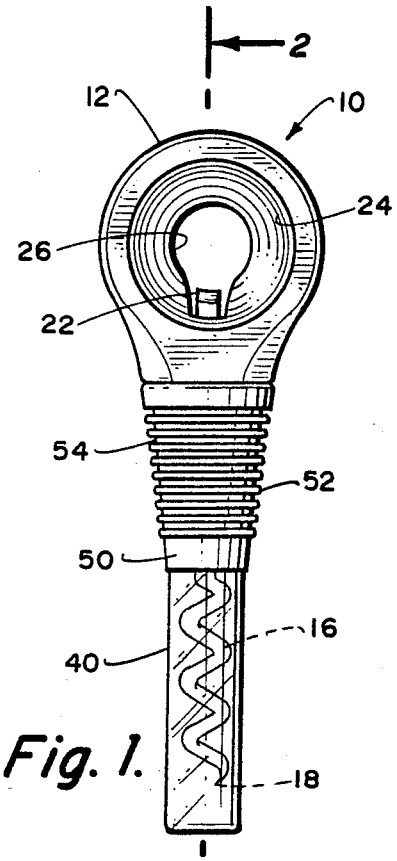
FIG. 1 is a front elevational view of the bottle opener and resealer of the present invention.
Figure 2:
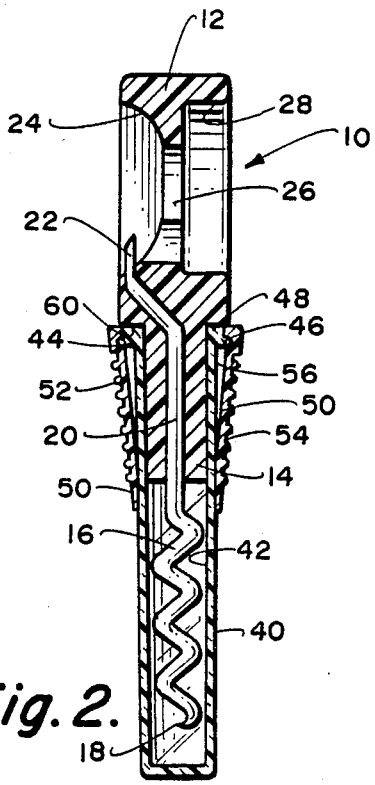
FIG. 2 is a cross-sectional view of the bottle opener and resealer of the present invention taken along line 2—2 of FIG. 1.

Referring particularly to the drawings, there is shown a bottle opener and resealer 10 of this invention which is composed mainly of a disc-shaped head 12. The head 12 will normally be constructed of an attractively colored plastic material, but could also be made of other materials such as metal.

The head 12 has opposing sides and within one of the sides there is formed a bottle cap opening recess 24 and with the other side is formed a bottle cap resealing recess 28. It is noted that the bottle cap opening recess 24 is cup-shaped, while the bottle cap resealing recess is more cylindrically shaped. The bottle cap resealing recess 28 is designed to be of a shape so as to closely conform with the conventional crimped type of bottle cap 30 which is shown within FIG. 6 of the drawings. There is a hole 26 connecting between the recesses 24 and 28, the purpose of which will be explained further on in this specification.

Integrally formed to the head 12 and extending therefrom is a cylindrically-shaped extension 14. Mounted within the extension 14 is a wire member 20. One end of the wire member 20 is formed into a hook type of projection 22 which extends within the bottle cap opening recess 24. The portion of the wire member 20 that extends exteriorly of the extension 14 is formed into a spiral corkscrew member 16. Corkscrew member 16 terminates in a tip 18.

To protect the corkscrew member 16, when not in use, there is to be located about corkscrew member 16 a rigid plastic protective sheath 40 which can be transparent. The transparency of the sheath 40 permits observation by a potential user to immediately know the function of this invention as a cork puller. The sheath 40 has an internal chamber 42 within which is to be located corkscrew member 16. The cross-sectional size of the internal chamber 42 is to be such that the extension 14 fits therein in a snug fitting manner. The sheath 40 has an open end about which is located a flange 48. An annular ridge 46 is exteriorly mounted on the flange 48. The outer surface of the flange is to abut against a shoulder 60 of the head 12.

Figure 3:
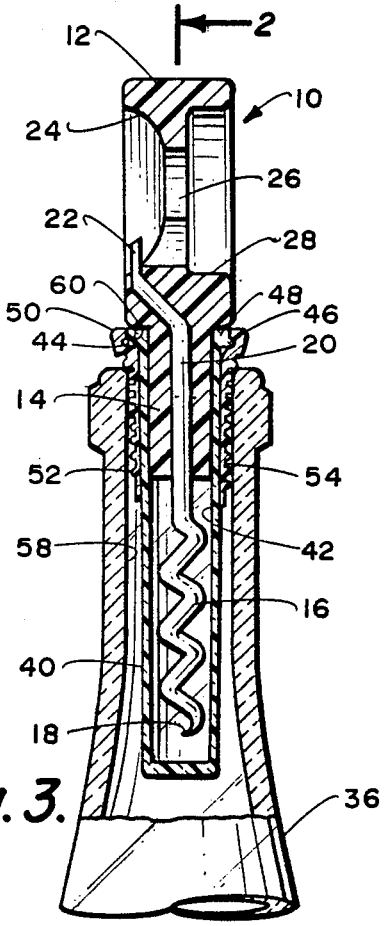
FIG. 3 is a view similar to FIG. 2, but showing the bottle opener and resealer of this invention installed within the neck of a bottle thereby resealing same.
Figure 4:
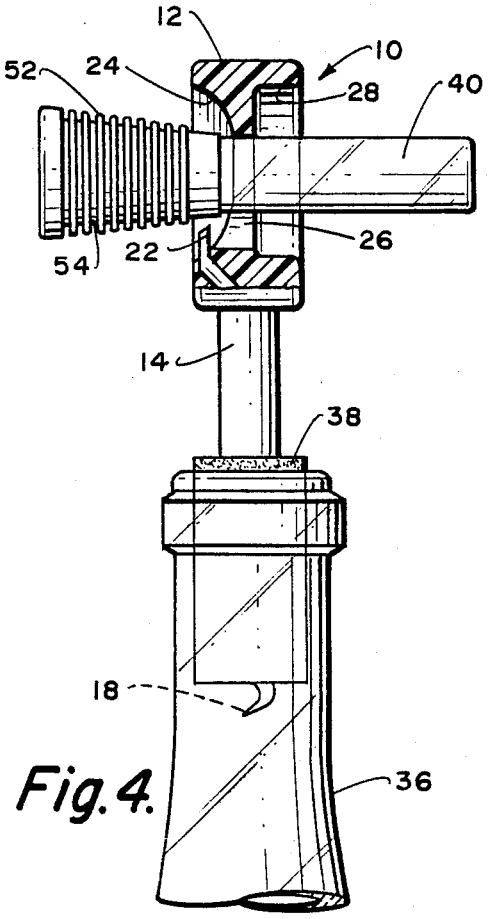
FIG. 4 is a side view, partly in cross-section, of the bottle opener and resealer of the present invention showing such in a position to remove a cork from a neck of a conventional bottle.

The annular ridge 46 is to engage with an annular groove 44 of a stopper member 50. The stopper member 50 is constructed of a plastic material which is substantially more flexible than the material of construction of the sheath 40. The reason for this, is that as the tapered stopper member 50 is inserted within the neck 58 of a bottle 36 the stopper member 50 will be flexed slightly. The deflection of the stopper member 50 toward the sheath 40 is permitted due to an annular gap 56 formed between the stopper member 50 and the sheath 40. This deflection is clearly shown within FIG. 3. In order to facilitate tight connection with the bottle 36, and to fit a variety of various sized bottles, the exterior surface of the stopper member 50 is formed to include a plurality of annular ridges 52 which are separated by a plurality of annular grooves 54. The stopper member 50 can be manufactured of other materials such as cork or rubber in which case the surface of the conical shape and manner of attachment to the sheath might vary.

Corkscrew member 16 is to be usable in a conventional manner with a cork 38 which is mounted within the neck 58 of a bottle 36. To facilitate insertion and removal of cork 38, the sheath 40 is to be disconnected from the extension 14 then inserted through the hole 26 essentially forming a "T" shaped member with the head 12 and the extension 14. This T-shaped member is to be operated as a handle to facilitate turning of the corkscrew member 16 as well as facilitating the exertion of a pulling force to remove the corkscrew member 38 from the opening 58 of the bottle 36.

Figure 5:
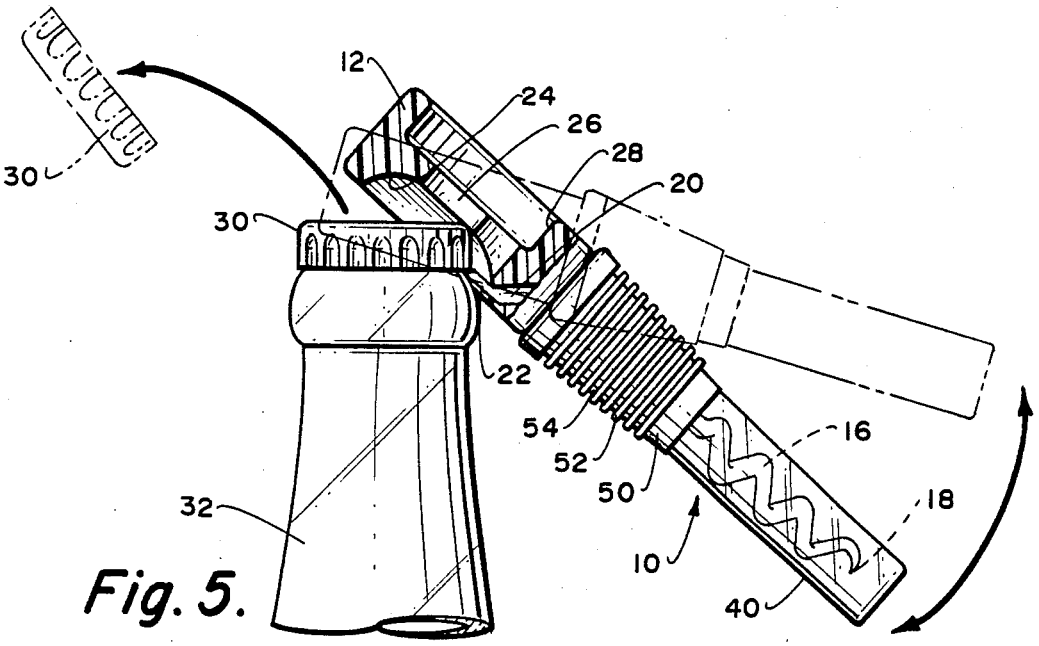
FIG. 5 is a side view, partly in cross-section, of the bottle opener and resealer of this invention depicting removal of a conventional bottle cap.
Figure 6:
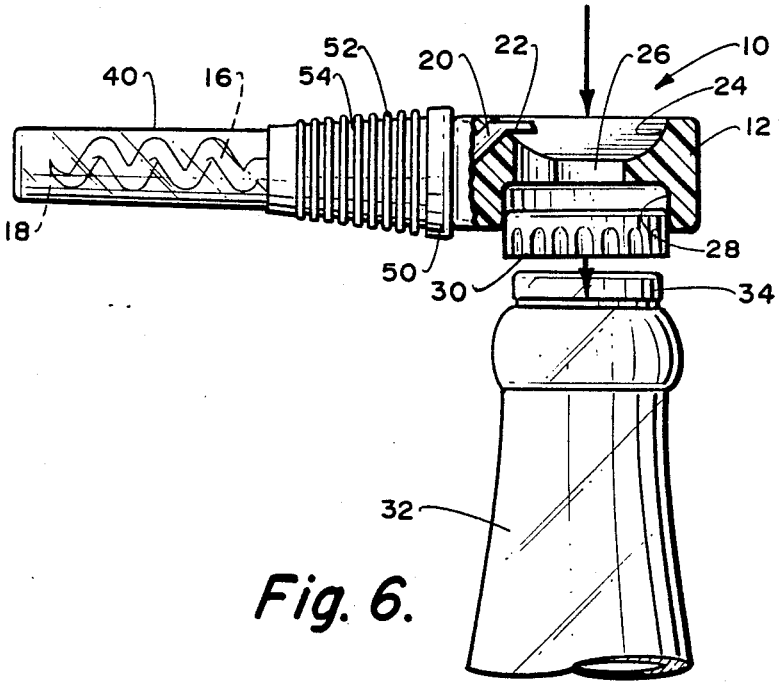
FIG. 6 is a side view, partly in cross-section, of the bottle opener and resealer of this invention showing resealing of the same bottle with a removed bottle cap.

In order to use the bottle opener and resealer 10 of this invention to remove a conventional crimped bottle cap 30 from a bottle 32, reference is to be had in particular to FIGS. 5 and 6 of the drawings. The operator places the bottle cap 30 within the bottle cap opening recess 24 and locates the projection 22 beneath an edge of a bottle cap 30. The operator then grasps the sheath 40 and applies a torque to pry the bottle cap 30 off of the neck area 34 of the bottle 32. Because the upper surface area of the bottle cap 30 is wholly supported within the recess 24, the bottle cap 30 is removed with a minimum amount of distortion. This minimizing of distortion is desirable when the bottle is to be resealed with a previously removed cap. The bottle cap 30 is then relocated on the neck 24 of the bottle. The cap 30 is then partially inserted in opening 28. Manual pressing or striking force is then applied to the head 12 which results in reinstallation of the cap 30 in position about the neck 34. As a result, the bottle cap 30 is crimped back onto the neck 34 of the bottle 32.

What is claimed is:

1. A bottle opener and resealer comprising:

a head member having opposing sides defined as one side and as the other side, a bottle cap opening recess formed within said one side, a bottle cap resealing recess formed within said other side, said bottle cap resealing recess adapted to accommodate in a close-fitting manner a conventional bottle cap;

a rigid projection mounted within said head member, said rigid projection extending within said bottle cap opening recess, said rigid projection adapted to be located under the edge of the bottle cap to facilitate removal of the bottle cap from a bottle by prying;

an extension attached to said head member, a corkscrew member imbedded within said extension, said corkscrew member having an inner end and an outer end, said outer end extending from said extension and adapted to remove a cork from a bottle, said inner end comprising said rigid protection;

a protective sheath mounted on said extension, said protective sheath being rigid, said protective sheath enclosing said corkscrew member, said protective sheath being removably engaged with said extension; and a stopper member mounted on said protective sheath, said stopper member being in the form of a sleeve surrounding said sheath, said sleeve assuming a tapered configuration relative to said sheath, a single annular gap formed between said sleeve and said sheath, said sleeve being locatable within the neck of a bottle for reclosing such which causes said sleeve to deflect into said gap providing a resilient snug connection with the neck of the bottle.

2. The bottle opener and resealer as defined in claim 1 wherein:

said sleeve having an exterior surface, said exterior surface being formed into a plurality of annular ridges further facilitating the snug connection with the neck of the bottle.

3. The bottle opener and resealer as defined in claim 2 wherein:

a hole formed within said head member, said hole connecting said bottle cap opening recess and said bottle cap resealing recess, said protective sheath being locatable within said hole so approximately an equal length of said sheath extends in each direction from each end of said hole thereby functioning as a graspable handle to facilitate operation of said corkscrew member.

4. The bottle opener and resealer as defined in claim 2 wherein:

said sleeve being constructed of material to be more flexible than the material of construction of said protective sheath.

5. The bottle opener and resealer as defined in claim 2 wherein:

said protective sheath being transparent.

* * * * *